US005803205A

United States Patent [19]

Kochem

[11] Patent Number: 5,803,205

[45] Date of Patent: Sep. 8, 1998

[54] FOLDING SAWHORSE

[76] Inventor: Robert C. Kochem, 21 Jason Rd., Belmont, Mass. 02178

[21] Appl. No.: 746,405

[22] Filed: Nov. 8, 1996

[51] Int. Cl.[6] ..... B27B 21/00

[52] U.S. Cl. ..... 182/153; 182/225

[58] Field of Search ..... 182/153, 225, 182/181.1, 155; 248/174; 211/195, 200; 108/157.14

[56] References Cited

U.S. PATENT DOCUMENTS

| | | | |
|---|---|---|---|
| 3,508,734 | 4/1970 | Thomas | 248/174 |
| 3,976,163 | 8/1976 | Watkinson | 182/151 |
| 4,759,520 | 7/1988 | Levine | 248/174 |
| 4,763,757 | 8/1988 | Cheney | 182/153 |
| 5,010,978 | 4/1991 | Jimmerson | 182/225 |
| 5,277,388 | 1/1994 | Denaro | 248/174 |
| 5,351,882 | 10/1994 | Krautsack | 248/174 |
| 5,443,168 | 8/1995 | Dyment | 248/174 |
| 5,582,267 | 12/1996 | Bockoven | 182/153 |

*Primary Examiner*—Alvin C. Chin-Shue
*Attorney, Agent, or Firm*—Iandiorio & Teska

[57] ABSTRACT

A folding sawhorse including a rigid planar center panel and a pair of hinged rigid planar end panels which can be folded flat against the rigid planar center panel when the sawhorse is not in use and swung into position and locked in place when the sawhorse is in use.

2 Claims, 4 Drawing Sheets

FOLDING SAWHORSE

FIELD OF INVENTION

This invention relates to a folding sawhorse of unitary design which is light weight and yet structurally stable and conveniently transportable and foldable for compact storage.

BACKGROUND OF INVENTION

Sawhorses, used by homeowners, are also a very common piece of equipment around any construction site. They are utilized for various functions such as supporting items being worked on or to serve as legs for a temporary table. Sawhorses are available in many different designs and are manufactured from numerous materials such as wood, plastic and metal. One of the best known varieties of sawhorses consists of a wooden crossbeam, usually a standard two-by-four, and a pair of metal brackets which affix four sections of two-by-four to be utilized as the legs. While this style is very popular and inexpensive, the result is an unstable sawhorse which requires assembly prior to use and disassembly for storage.

The art includes examples of attempts at improving this traditional design. The issue of stability is addressed through the design of sawhorses constructed of planar materials, such as plywood. These types of sawhorses often consist of a crossbeam, which is constructed from a planar material, and a pair of legs, constructed of a similar planar material, which are removably attached to the crossbeam. See, e.g., U.S. Pat. No. 4,574,917. The legs utilized in this particular variety of sawhorse usually attach to the crossbeam through some form of slot or tab arrangement. This design was subsequently expanded on to include sawhorses that have multiple crossbeams and alternate leg designs. See, e.g., U.S. Pat. Nos. 4,105,091 and 4,433,753. Over the years, sawhorses of this variety have been constructed from numerous materials such as plywood, sheet plastic, injection-molded plastic and metal. The legs utilized in these sawhorses come in various designs and varieties such as triangular plywood sheets and injection-molded polymer resin triangular-shaped I-beam assemblies. See, e.g., U.S. Pat. No. 5,427,200. While this particular design provides a more stable sawhorse, the complicated multi-piece design suffers from other limitations. The shortcomings of a multi-piece sawhorse are exacerbated by the fact that sawhorses are traditionally used at construction sites and are constantly being transported to and moved around the construction site. Accordingly, one shortcoming of the multi-piece sawhorse design is that discrete pieces of the sawhorse may be lost or misplaced as the construction site changes.

The desire for a one-piece collapsible sawhorse led to some designs which posed numerous solutions. One such sawhorse design utilizes the traditional wooden crossbeam and wooden legs attached to the crossbeam through the use of a collapsible bracket. While this design provides a sawhorse of unitary design, the use of nonplanar material results in a sawhorse which is not stable enough for heavy-duty construction use. Further refinements of this design include sawhorses which utilize the traditional wooden crossbeam and steel or plastic legs. Sometimes these legs are reinforced through the use of a crossbrace at the base of the legs. However, while substantially stronger than separate non-crossbraced legs, these designs are unacceptably unstable.

Alternative unitary sawhorse designs have been developed which incorporate legs, constructed of sections of two-by-four, which swing vertically and fold flat against the sawhorse's center section or crossbeam. See, e.g., U.S. Pat. No. 4,508,194. While this sawhorse design provides a sawhorse of improved stability, the inability to lock the legs in an open position during use and the substantial weight of this device renders it less than desirable for commercial use.

SUMMARY OF INVENTION

It is therefore an object of this invention to provide a folding sawhorse of unitary design.

It is a further object of this invention to provide such a folding sawhorse incorporating legs which are permanently affixed to the sawhorse's center section, thus preventing misplacement of the individual components of the sawhorse.

It is a further object of this invention to provide such a sawhorse which folds flat for compact storage and easy transportation.

It is a further object of this invention to provide such a folding sawhorse incorporating legs which can easily be unfolded from the storage position and locked into place.

It is a further object of this invention to provide such a folding sawhorse which is lightweight and collapsible for easy storage, yet rigid and structurally stable, thereby providing a stable work surface.

This invention results from the realization that a unitary, stable, rigid and yet collapsible sawhorse can be constructed by using a set of rigid planar legs affixed to a rigid planar center panel if the legs are hinged to the center panel so they can easily be swung and locked into position during use and subsequently unlocked and folded flat against the center panel thus providing for compact storage and easy portability and use. Such a sawhorse is light weight, unitary in design and does not need to be assembled prior to each use and disassembled prior to storage.

This invention features a folding sawhorse. There is a rigid planar center panel, a first rigid planar end panel, a second rigid planar end panel, first hinge means for pivotally attaching the first rigid planar end panel to the rigid planar center panel, and second hinge means for pivotally attaching the second rigid planar end panel to the rigid planar center panel.

There are means for locking the first and second rigid planar end panels in a position essentially perpendicular with the rigid planar center panel. Various forms of locking means can be utilized to accomplish this task. A flap can be pivotally attached to a rigid planar end panel and swung into position to releasably engage the rigid planar center panel, thus preventing the inadvertent folding of the rigid planar end panels.

In another embodiment, a bracket can be employed to extend between a rigid planar end panel and the rigid planar center panel. Additionally, a locking hinge can be utilized to enable the rigid planar end panels to be locked into position essentially perpendicular with the rigid planar center panel.

The rigid planar center panel utilized in this invention may contain cutouts and hand holds. Additionally, the rigid planar end panels may be triangular in shape. The sawhorse is very stable due to the use of a planar center panel and a pair of planar end panels or legs. At the same time, the sawhorse is foldable flat for storage by hinging the end panels with respect to the center panel.

DISCLOSURE OF PREFERRED EMBODIMENT

Other objects, features and advantages will occur to those skilled in the art from the following description of a preferred embodiment and the accompanying drawings, in which.

Figure 1A:
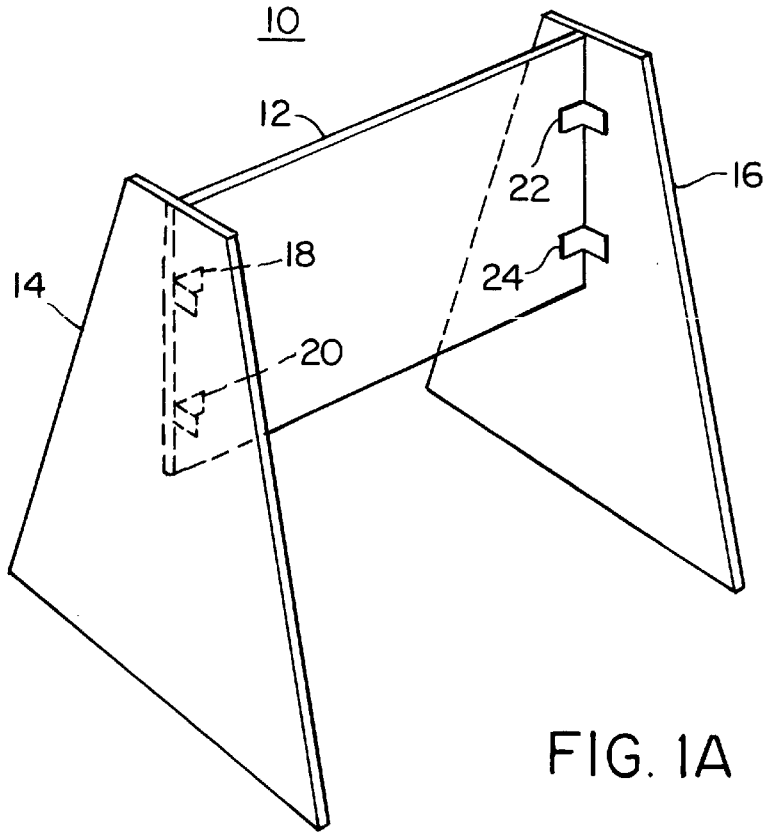
FIG. 1A is a three-dimensional schematic view of the folding sawhorse of this invention in position for use.
Figure 1B:
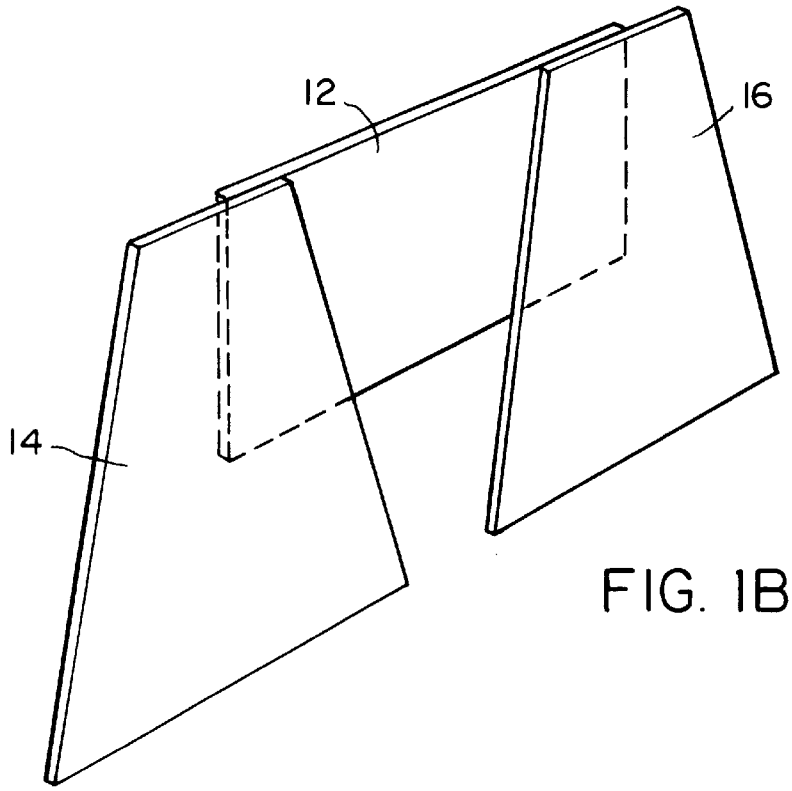
FIG. 1B is a three-dimensional schematic view of the folding sawhorse of FIG. 1 in the storage position.

One embodiment of the folding sawhorse 10 of this invention is shown in use in FIG. 1A and folded flat for storage in FIG. 1B. Folding sawhorse 10 preferably includes rigid planar center panel 12, first rigid planar end panel 14, and hinges 18 and 20 for pivotally attaching rigid planar center panel 12 to first rigid planar end panel 14. There is a second rigid planar end panel 16 and hinges 22 and 24 for pivotally attaching rigid planar center panel 12 to second rigid planar end panel 16. Hinges 18, 20, 22 and 24 may be discrete hinges, piano-type hinges, or any other means of providing a pivoting joint between rigid planar end panels 14 and 16 and rigid planar center panel 12. Hinges 18, 20, 22 and 24 allow rigid planar end panels 14 and 16 to fold flat against rigid planar center panel 12 as shown in FIG. 1B when the sawhorse is not in use. This enables the sawhorse to be conveniently stored and transported. Sawhorse 10 is very stable, however, due to the use of planar center panel 12 and planar end panels 14 and 16. Center panel 12 and end panels 14 and 16 may be manufactured from plywood or any other relatively rigid and structurally sound material.

In use, rigid planar end panels 14 and 16, when folded away from rigid planar center panel 12 and placed in a position essentially perpendicular to rigid planar center panel 12, can be locked in place using locking means to prevent the accidental or inadvertent folding back of the rigid planar end panels 14 and 16 into the storage position. Various types of locking means are shown in FIGS. 2, 3 and 4.

Figure 2:
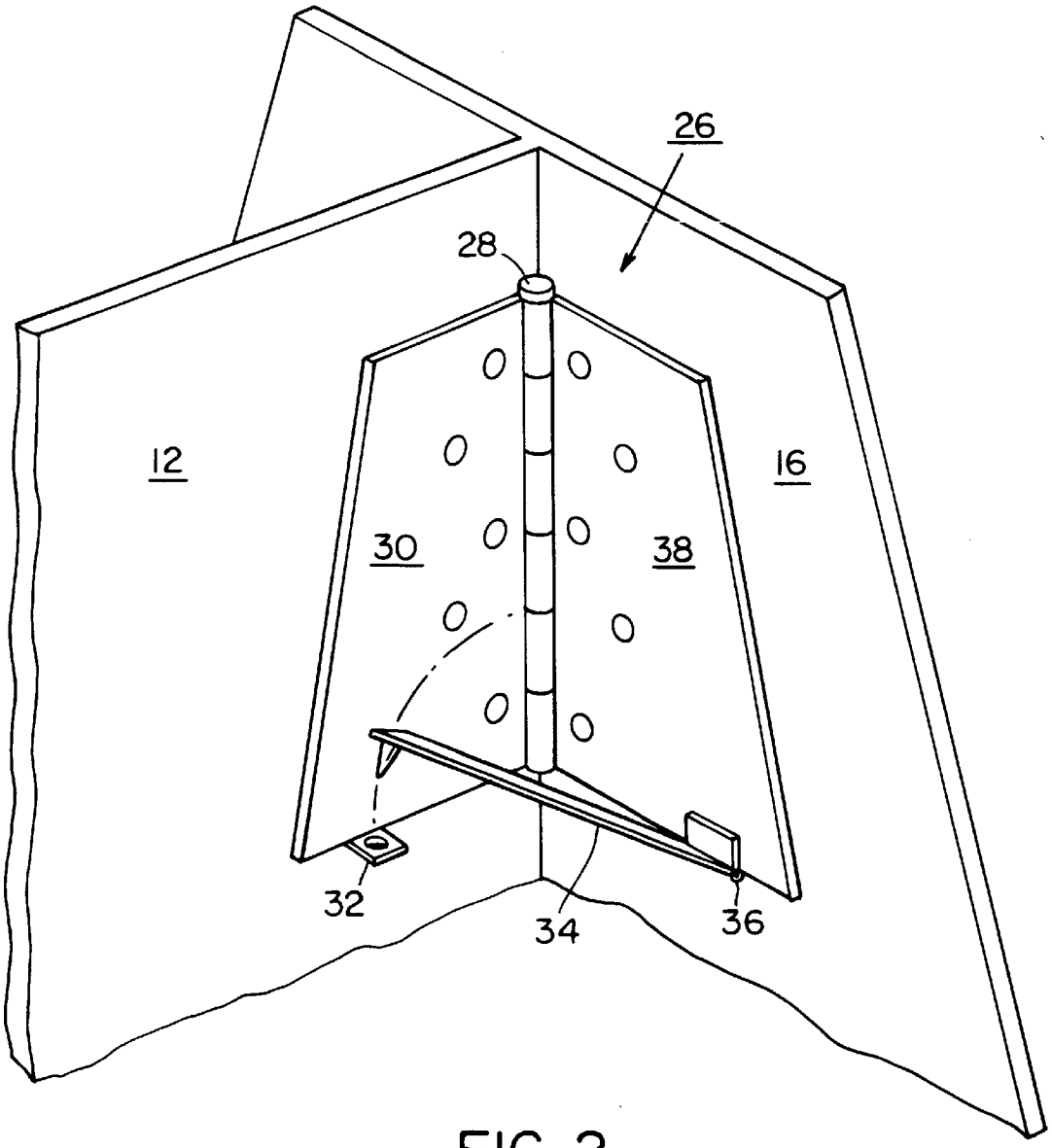
FIG. 2 is a schematic view of the locking hinge assembly for the sawhorse of this invention.

FIG. 2 shows one embodiment of locking means, locking hinge 26, for locking first rigid planar end panel 16 essentially perpendicular to rigid planar center panel 12. Locking hinge 26 includes hinge plates 30 and 38, hinge pin 28, and locking bracket 34 pivotally attached to hinge plate 38 via a hinge 36. When locking hinge 26 is utilized and rigid planar end panel 16 is swung into a position perpendicular to the rigid planar center panel 12, hinge plates 38 and 30 are essentially perpendicular to each other and locking bracket 34 swings about hinge 36 and releasably engages hinge bracket 32, thus locking rigid planar end panels 14 and 16 into a position essentially perpendicular with rigid planar center panel 12.

Figure 3:
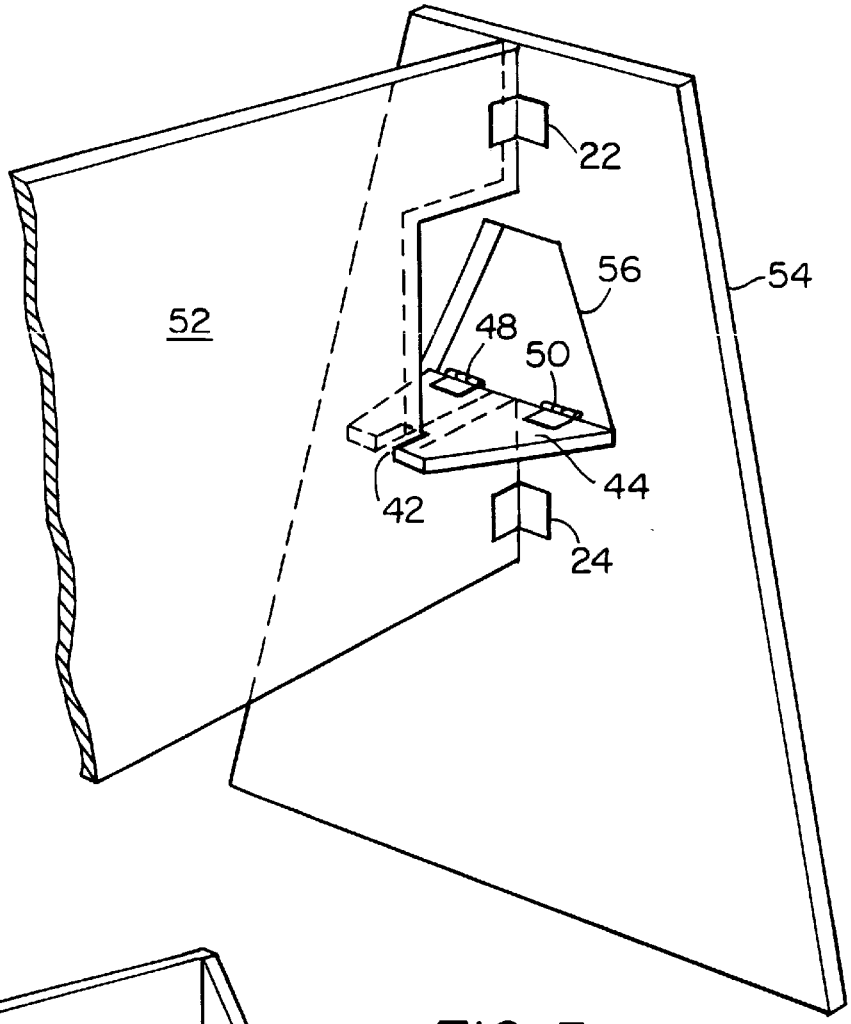
FIG. 3 is a three-dimensional schematic view of a locking flap assembly for the sawhorse of this invention.

The preferred embodiment of locking means is shown in FIG. 3. There is a flap 44 pivotally attached to rigid planar end panel 54 via hinges 48 and 50. Flap 44 has notch 42 designed to engage rigid center planar center panel 52. When this locking means is utilized and rigid planar end panel 54 is swung about hinges 22 and 24 into a position essentially perpendicular to rigid planar center panel 52, flap 44 is swung from a position within cutout 56 to a position which releasably engages notch 42 with rigid planar center panel 52 as shown.

Figure 4:
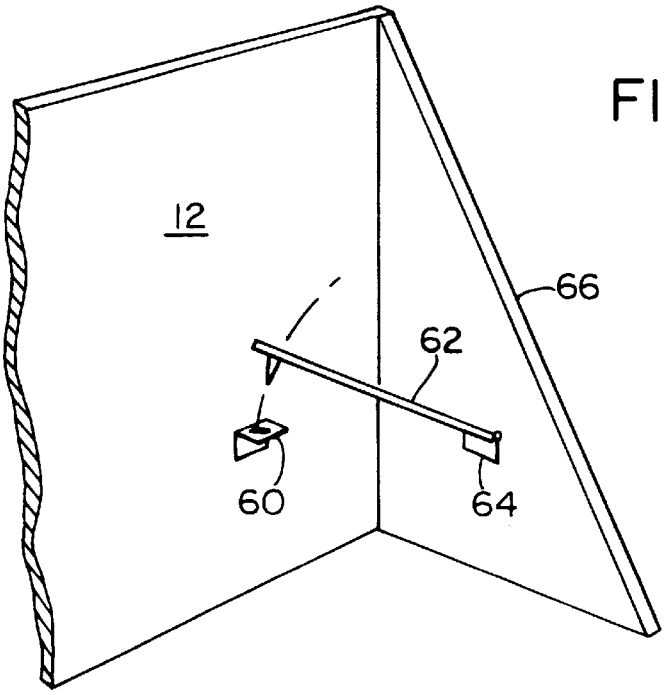
FIG. 4 is a three-dimensional schematic view of a locking bracket assembly for the sawhorse of this invention.

Another embodiment of locking means is shown in FIG. 4. There is locking bracket 62, pivotally attached to rigid planar end panel 66 via hinge 64. When rigid planar end panel 66 swings into a position essentially perpendicular to rigid planar center panel 12, locking bracket 62 swings about hinge 64 and releasably engages hinge bracket 60 affixed to center panel 12.

Figure 5A:
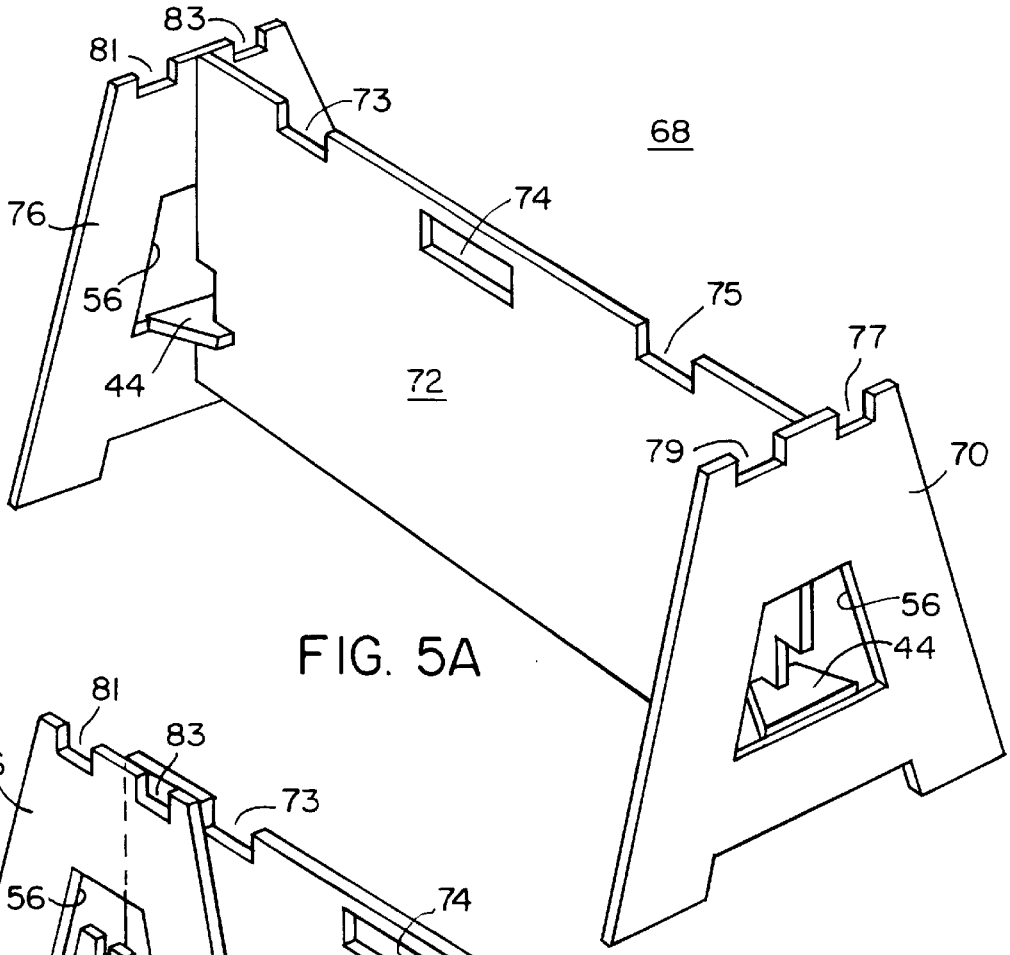
FIG. 5A is a three-dimensional schematic view of the folding sawhorse of this invention with a locking flap assembly, in position for use.
Figure 5B:
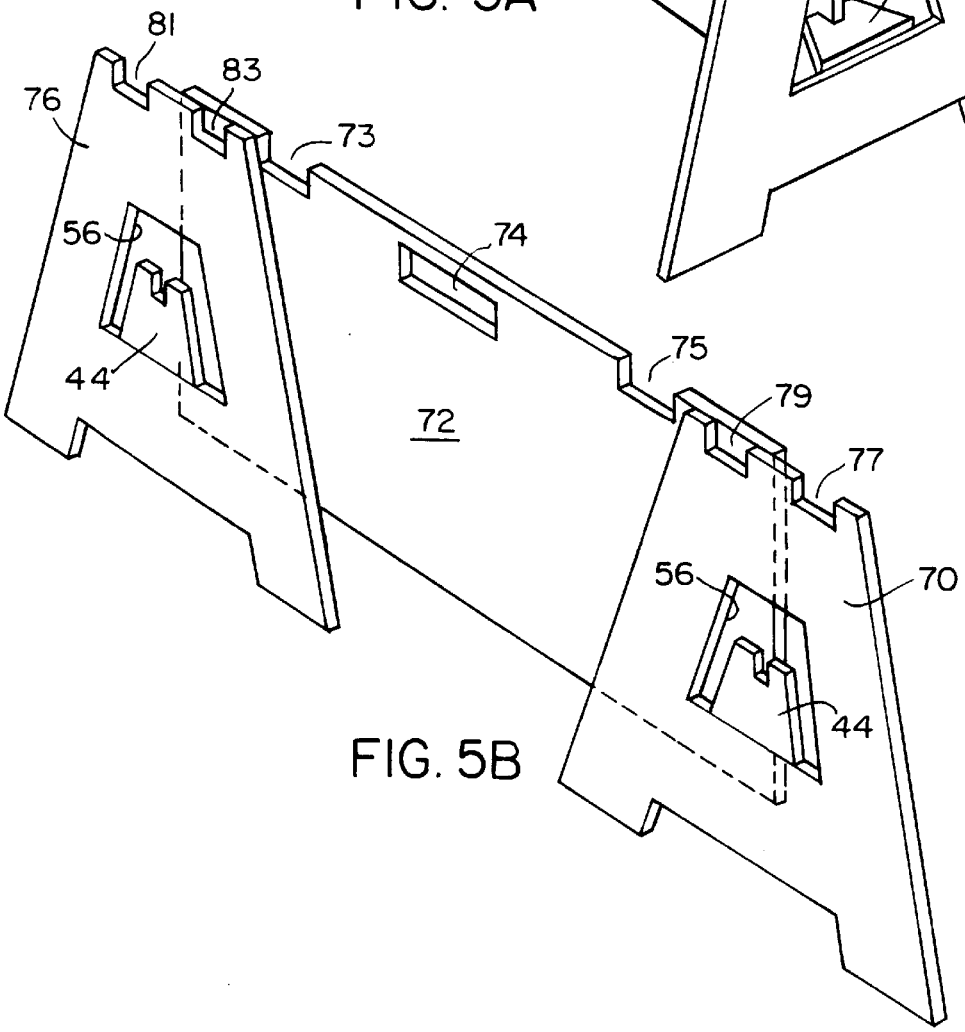
FIG. 5B is a three-dimensional schematic view of the folding sawhorse of FIG. 5A in the storage position.

In another embodiment, folding sawhorse 68, FIGS. 5A and SB, includes rigid center panel 72 with hand hold 74, a pair of rigid triangular shaped planar end panels 70 and 76, and a pair of flaps 44 releasably engaged with rigid planar center panel 72 as shown. FIG. 5B shows the same folding sawhorse collapsed for easy storage and transportability. The pair of rigid triangular shaped planar end panels 70 and 76 are folded flat against rigid planar center panel 72 and flaps 44 are folded into a position within cutout 56. Cut-outs 73 and 75 on center panel and cut-outs 77, 79, 81, and 83 on end panels 70 and 76 are useful for creating a table or other support structure and are sized to receive, for example, two by fours.

The folding sawhorse of this invention provides a combination of benefits not achieved by any of the prior art. The sawhorse of this invention is unitary in design, structurally sound and rigid, and yet light weight. The sawhorse of this invention possesses the unique ability of being able to fold flat, when not in use, for easy storage and transportability.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A one-piece folding sawhorse consisting essentially of:

a one-piece rigid planar center panel having a left edge, a right edge, a top edge and a bottom edge;

a first rigid planar end panel having a lower edge, a left edge and a right edge;

first hinge means for pivotally attaching said left edge of said rigid planar center panel to said first rigid planar end panel, wherein the rigid planar center panel is centrally located between the left and right edges of the first rigid planar end panel and the center panel is disposed perpendicular to the lower edge of the first rigid planar end panel, thereby allowing the first rigid planar end panel to pivot to a position essentially parallel to and about the rigid planar center panel along a hinge axis essentially parallel to the left edge of the rigid planar center panel;

a second rigid planar end panel having a lower edge, a left edge, and a right edge;

second hinge means for pivotally attaching said right edge of said rigid planar center panel to said second rigid planar end panel, wherein the rigid planar center panel is centrally located between the left and right edges of the second rigid planar end panel and the center panel is disposed perpendicular to the lower edge of the second rigid planar end panel, thereby allowing the second rigid planar end panel to pivot to a position essentially parallel to and about the rigid planar center panel along a hinge axis essentially parallel to the right edge of the rigid planar center panel; and locking means for releasably fixing the first and second rigid planar end panels in a position essentially perpendicular to the rigid planar center panel wherein said locking means comprises a flap pivotally attached to at least one of the rigid planar end panels and releasably engageable with at least one of the left or right edges of the rigid planar center panel.

2. The one-piece folding sawhorse of claim 1 wherein said first and second rigid planar end panels are essentially triangular in shape.

* * * * *